United States Patent [19]

Schwartz

[11] 3,996,682

[45] Dec. 14, 1976

[54] SELF CONTAINED FRAME

[75] Inventor: Richard Schwartz, N. Bellmore, N.Y.

[73] Assignee: North American Enclosures, Inc., Bay Shore, N.Y.

[22] Filed: Nov. 12, 1975

[21] Appl. No.: 631,268

[52] U.S. Cl. ..... 40/156; 40/152

[51] Int. Cl.[2] ..... G09F 1/12

[58] Field of Search ..... 40/156, 152, 152.1; 52/475

[56] References Cited

UNITED STATES PATENTS

| | | | |
|---|---|---|---|
| 2,523,815 | 9/1950 | Cloyd | 40/156 |
| 2,807,110 | 9/1957 | Buedingen | 40/156 |
| 3,670,439 | 6/1972 | Shimizu | 40/156 |
| 3,879,873 | 4/1975 | Sawyer | 40/156 |
| 3,899,844 | 8/1975 | Munn | 40/156 |

FOREIGN PATENTS OR APPLICATIONS

| | | | |
|---|---|---|---|
| 898,770 | 7/1944 | France | 40/152 |
| 649,455 | 1/1951 | United Kingdom | 40/152 |
| 857,673 | 1/1961 | United Kingdom | 40/152 |

*Primary Examiner*—John F. Pitrelli
*Attorney, Agent, or Firm*—Howard C. Miskin

[57] ABSTRACT

A picture frame has a lip for supporting the front of a picture and at least one groove. Resilient means, such as spring clips, have tongues for insertion into the groove. The clips support the rear of the picture and can hold pictures of varying thickness. A second groove can be disposed behind said first groove for holding extra thick pictures, such as canvasses.

12 Claims, 3 Drawing Figures

SELF CONTAINED FRAME

The present invention relates to picture frames, and more particularly to ones that can hold pictures of varying thickness.

Present picture frames are limited in the thickness of the pictures that they can hold. This means that manufacturers must make, and dealers must stock, a large number of different types to accommodate prospective buyers. This is obviously expensive and takes up valuable shelf and storage space of retailers. Also prior art frames are difficult to assemble, usually requiring the insertion of nails or tacks at the back, which requires a certain degree of skill. Still further, these tacks frequently work loose and come out, thereby making it possible for the picture to drop out. The objections result with both wood and metal frames.

It is therefore an object of the present invention to provide a picture frame that can hold pictures of varying thickness.

It is another object to provide a one-piece frame that can be assembled by unskilled labor, such as an ordinary housewife.

It is yet another object to provide one that securely holds the picture in place.

In brief, these and other objects are achieved by having picture display device comprising a frame and a glass panel and a resilient means disposed in the frame for holding the picture in the frame against the glass. Since the holding means is resilient, the display device can accommodate pictures of varying thickness. The frame has at least one groove and the holding means has tongues for easy and secure insertion into the groove by unskilled labor. If desired, the frame can have a second groove disposed behind the first groove to accommodate still thicker pictures.

Other objects, features, and advantages will become apparent from the following description when taken in conjunction with the drawings in which.

Figure 1:
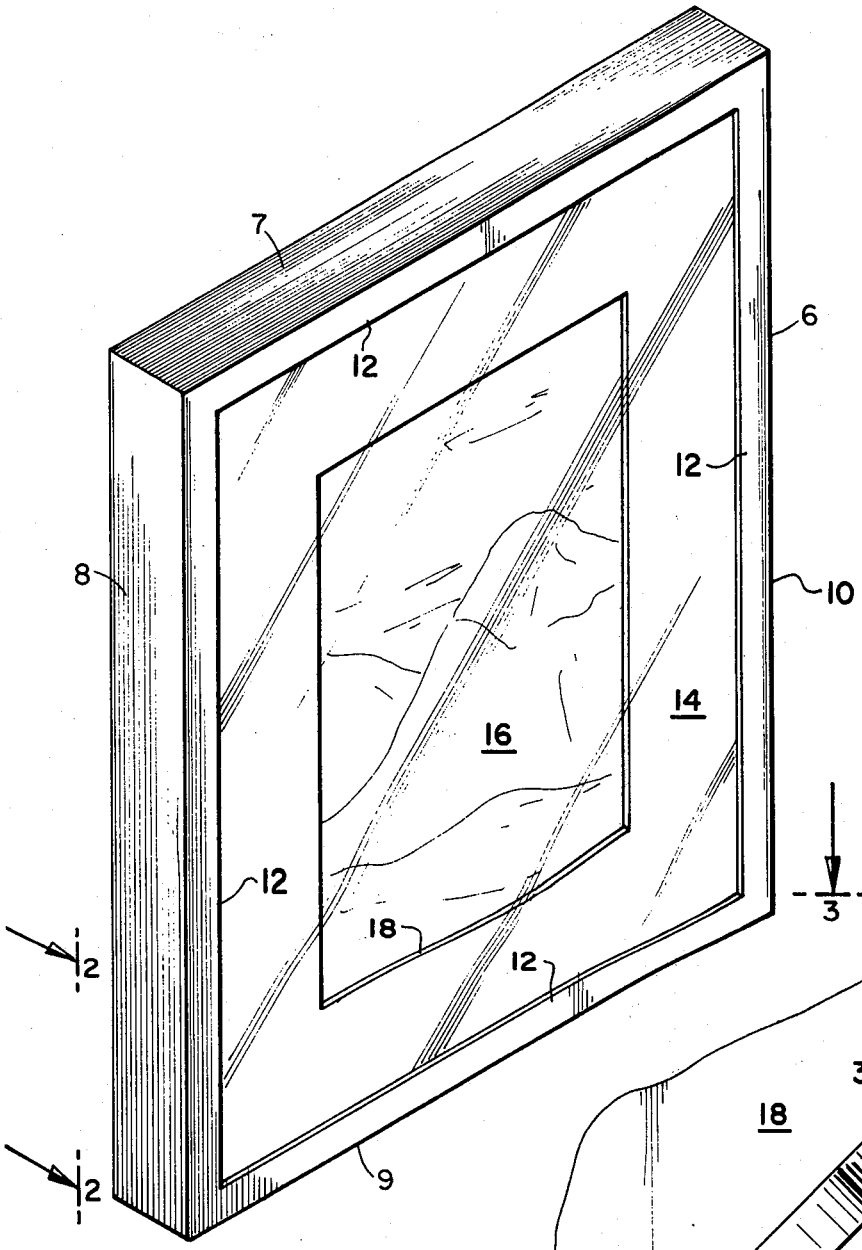
FIG. 1 is an isometric view of the invention with a picture inserted.

FIG. 1 shows a rectangular frame made of aluminum and generally indicated by the numeral 10. Frame 10 has four legs 6, 7, 8 and 9 joined at four corners, each leg having an inwardly extending front lip 12 that also extends about the entire periphery of frame 10. Beneath the lip 12 is a rectangular piece of transparent material 14, such as glass or plastic, and beneath material 14 lies a picture 16 mounted on a mat 18. It will be readily seen that material 14 protects the picture 16 and that both of them are secured against motion in the forward direction by lip 12. Of course, if desired, material 14 could be eliminated.

Figure 2:
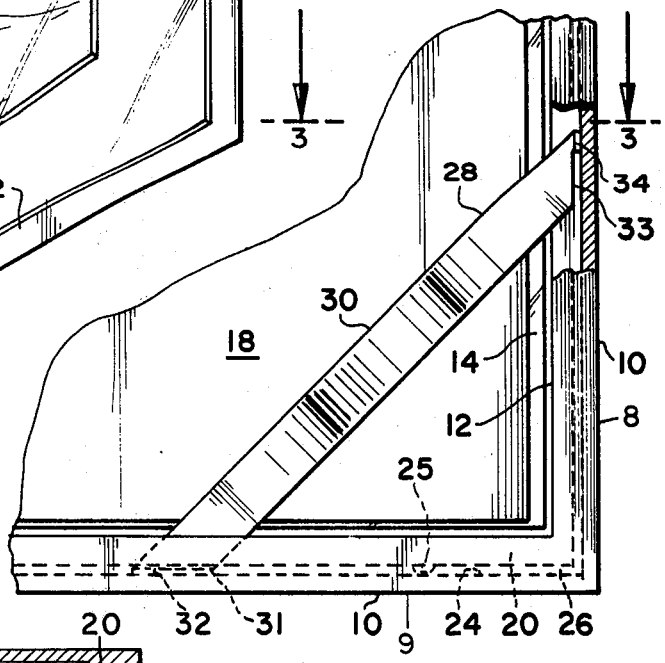
FIG. 2 is a partial cross-sectional rear view looking from the lines 2—2 in FIG. 1.
Figure 3:
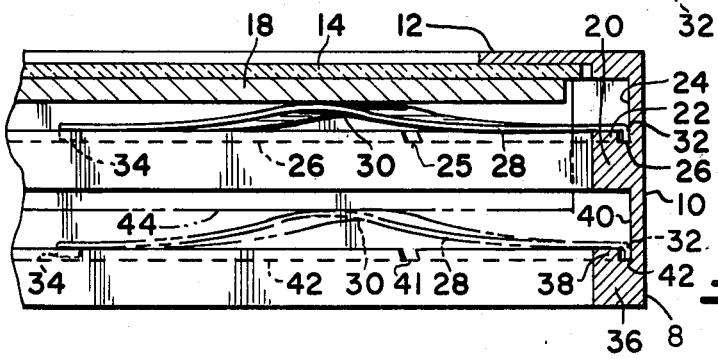
FIG. 3 is a cross-sectional view taken along lines 3—3 of FIG. 2, showing an alternative picture holding in phantom.

FIGS. 2 and 3 show the details of how the picture 16 and material 14 are secured in the frame 10. In particular, frame 10 has an inwardly extending projection 20, which in turn has a forwardly extending flange 22. The inner surface 24 of frame 10 together with flange 22 define a first groove 26 that extends about the inside of frame 10. Each flange 22 adjacent each corner has a cut out or notch 25 communicating with groove 26. A resilient spring clip 28, made from spring steel lies diagonally across a corner of frame 10 and has a generally shallow V-shaped deformation 30 that abuts the back of mat 18. Spring clip 30 also has at its end tongues 32 and 34 extending in the direction opposite to the apex of the V that lie in the groove 26. Tongues 32 and 34 are generally perpendicular to the plane of clip 30 and are passable through cut out 25 into its respective groove 26. Advantageously one side edge at each end of each clip is tapered as at 31 and 33, to form a point, which is bent upwardly to form the tongues 32 and 34 respectively. The tapered edges 31 and 32 abut the inner surfaces of 24.

Frame 10 also comprises a second inwardly extending projection 36, which in turn has a forwardly extending flange 38. The inner surface 40 of frame 10 together with flange 38 define a second groove 42 that extends about the inside of frame 10, spaced a predetermined distance from groove 26. Each of flanges 38, like flanges 22 has a cut out or notch 41, through which tongues 32 and 34 pass. As shown in dotted lines in FIG. 3, clip 28 can alternatively have its tongues 32 and 34 placed in groove 42. This is done if a thick picture 44, such as a canvas painting, is to be displayed. It will be appreciated that although only one clip 28 has been shown there are three identical other ones extending diagonally across each of the other three corners of frame 10.

To use the device of the present invention, first the glass 14 is placed inside the frame 10 with its front side abutting the rear side of lip 12. Then the picture 16 on mat 18 or the canvas picture 44 is placed against glass 14. Clip 28 is then placed with deformation 30 against either mat 18 or picture 44 and diagonally with respect to a corner of frame 10. The ends of clip 30 are then forwardly depressed and the clip 30 is moved towards the corner passing tongues 32 and 34 through notches 25, or 41, depending on the groove, and into groove 26 or 42 and away from the cut outs, so as to abut either inner wall 24 or 40. Then the forward pressure is relieved, and tongues 32 and 34 will be pressed by clip 28 into either groove 26 or 42 and remain there. To remove the picture 16 or 44, the ends of clip 28 are forwardly depressed and tongues 32 and 34 alternatively slid along the grooves 26 or 42 and outwardly through the notches 25 or 41 respectively, to remove the tongues 32 and 34 from the groove 26 or 42, and the clip is slid towards the center of the picture and removed. The picture can now be removed.

It will be appreciated that even if only one of the grooves 26 or 42 are present, the resiliency of clip 28 allows the frame 10 to hold pictures with a considerable range of thicknesses. The insertion and removal of the clip 28 is a simple procedure that can be handled by an unskilled person, and the tongues 32 and 34 and groove 26 or 42 interlock to form a mounting that will not work loose.

It will be further appreciated that many other embodiments are possible without departing from the spirit and scope of the invention.

What is claimed is:

1. A picture display device comprising: a frame defined by four side members connected at their ends, each pair of connected ends forming a corner, said frmae having an inwardly extending lip formed on the forward edge thereof adapted to engage the peripheral edge surface of a picture; a first groove formed in said frame rearwardly of said lip and extending parellel thereto, said groove opening in a forward direction; at least two resilient clip members, each lip member including a central portion having a surface adapted to resiliently abut the rear of said picture to urge it into engagement with said lip and a pair of end portions, each clip member extending angularly across a respective frame corner with said end portions extending resiliently into and being captured within said forwardly opening groove so that lateral movement of said clip end portions out of said groove is normally prevented, each of said clip members comprising a generally V-shaped body member, having an apex portion including said surface adapted to abut the rear of said picutre, said clip body member being tapered at each end and said clip end portions including a tongue extending from said tapered end.

2. A picture display device as recited in claim 1 wherein the clip body member is tapered at each end and said clip end portions include a tongue extending from said tapered end.

3. A picture display device as recited in claim 1 wherein said tongue extends substantially perpendicularly to the plane of the body member portion adjacent thereto.

4. A device as in claim 3 wherein said groove has a cut out adjacent each corner of said frame through which the tongues of said clip pass into and out of said groove.

5. A picture display device as recited in claim 1 further comprising a second groove formed in said frame rearwardly of said first groove extending parallel thereto, said second groove opening in a forward direction.

6. A device as claimed in claim 5 wherein corresponding edges at each end portion of the clip are tapered inwardly to form a point at the end, which point is bent rearwardly to form said tongues.

7. A device as claimed in claim 1 wherein said frame comprises aluminum and said clip member comprises spring steel.

8. A picture display device as recited in claim 1 wherein said tongue is a point at each end of the clip formed by at least one edge of the clip being tapered inwardly towards the other edge.

9. A picture display device comprising: a frame defined by four side members connected at their ends, each pair of connected ends forming a corner, said frame having an inwardly extending lip formed on the forward edge thereof adapted to engage the peripheral edge surface of a picture; a first groove formed in said frame rearwardly of said lip and extending parallel thereto, said groove opening in a forward direction; at least two resilient clip members, each clip member including a central portion having a surface adapted to resiliently abut the rear of said picture to urge it into engagement with said lip and a pair of end portions, each clip member extending angularly across a respective frame corner with said end portion extending resiliently into and being captured within said forwardly opening groove so that lateral movement of said clip end portions out of said groove is normally prevented, said clip end portions being tapered at each end and include a tongue extending from each of said tapered ends, said tongue extending generally perpendicularly to the plane of the clip member portion adjacent thereto.

10. A picture display device as recited in claim 9 further comprising a second groove formed in said frame rearwardly of said first groove extending parallel thereto, said second groove opening in a forward direction.

11. A device as claimed in claim 9 wherein said frame comprises aluminum and said resilient means comprises spring steel.

12. A picture display device as recited in claim 9, wherein each of said clip members comprises a substantially V-shaped body member, having an apex portion including said surface adapted to abut the rear of said picture.

* * * * *

UNITED STATES PATENT OFFICE

CERTIFICATE OF CORRECTION

PATENT NO. :3,996,682

DATED :December 14, 1976.

INVENTOR(S) : Richard Schwartz

It is certified that error appears in the above-identified patent and that said Letters Patent are hereby corrected as shown below:

Please change the Post Office address of the inventor to read as follows:

Woodbury, New York

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*